US009793662B2

(12) United States Patent
Kao et al.

(10) Patent No.: US 9,793,662 B2
(45) Date of Patent: Oct. 17, 2017

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Yang-Yang Zhou, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/949,051

(22) Filed: Nov. 23, 2015

(65) Prior Publication Data

US 2016/0156144 A1 Jun. 2, 2016

(30) Foreign Application Priority Data

Nov. 27, 2014 (CN) ..... 2014 1 0694120

(51) Int. Cl.
*H01R 24/00* (2011.01)
*H01R 24/60* (2011.01)
*H01R 13/6581* (2011.01)
*H01R 107/00* (2006.01)

(52) U.S. Cl.
CPC ..... *H01R 24/60* (2013.01); *H01R 13/6581* (2013.01); *H01R 2107/00* (2013.01)

(58) Field of Classification Search
CPC ..... H01R 24/60
USPC ..... 439/676, 660
See application file for complete search history.

(56) References Cited

U.S. PATENT DOCUMENTS 5,057,028 A * 10/1991 Lemke ..... H01R 23/688 439/101
6,663,423 B2 * 12/2003 Belopolsky ..... H01R 13/7195 439/541.5
6,709,286 B1 * 3/2004 Korsunsky ..... H01R 13/743 439/557
6,935,896 B1 * 8/2005 Tsai ..... H01R 13/506 439/541.5
6,997,733 B2 * 2/2006 Peng ..... H01R 13/6582 439/353
7,175,465 B1 * 2/2007 Tsai ..... H01R 13/6275 439/352
7,252,548 B2 * 8/2007 Huang ..... H01R 13/65802 439/607.01
7,390,220 B1 * 6/2008 Wu ..... H01R 9/03 439/607.06
7,462,071 B1 * 12/2008 Wu ..... H01R 9/032 439/497
7,465,194 B1 * 12/2008 Ho ..... H01R 9/032 439/607.01

(Continued)

*Primary Examiner* — Tulsidas C Patel
*Assistant Examiner* — Peter G Leigh

(57) ABSTRACT

An electrical plug connector includes an insulated housing and a rear terminal organizer. The rear terminal organizer is assembled to the rear of the insulated housing. The rear terminal organizer includes a base and a gluing passage. The front of the base corresponds to the rear of the insulated housing. The width of the base is greater than the width of the insulated housing. The periphery of the base is protruded from the periphery of the insulated housing. The gluing passage is formed at a peripheral area of the base, and the gluing passage is defined through the base from the front to the rear.

18 Claims, 11 Drawing Sheets

(56) References Cited

U.S. PATENT DOCUMENTS 7,628,638 B2 * 12/2009 Wu ..... H01R 9/032 439/353
7,632,155 B1 * 12/2009 Wu ..... H01R 9/035 439/497
7,670,199 B2 * 3/2010 Nagata ..... H01R 13/6474 439/101
7,824,198 B2 * 11/2010 Tanaka ..... H01R 9/034 439/108
7,824,219 B2 * 11/2010 Wang ..... H01R 13/65802 439/607.27
7,833,058 B2 * 11/2010 Zhang ..... H01R 13/508 439/607.41
8,113,865 B1 * 2/2012 Yang ..... H01R 13/4367 439/353
8,197,281 B2 * 6/2012 Yang ..... H01R 4/023 439/499
8,262,411 B2 * 9/2012 Kondo ..... H01R 13/6658 439/607.01
8,262,420 B2 * 9/2012 Xiong ..... H01R 13/506 439/607.23
8,353,731 B1 * 1/2013 Huang ..... H01R 13/514 439/701
8,651,874 B2 * 2/2014 Ku ..... H01R 35/02 439/31
8,696,385 B2 * 4/2014 Wu ..... H01R 13/506 439/607.56
8,894,441 B2 * 11/2014 Wu ..... H01R 13/6598 439/607.01
9,106,036 B2 * 8/2015 Yang ..... H01R 24/60
9,166,342 B1 * 10/2015 Tao ..... H01R 13/6581
9,281,621 B2 * 3/2016 Tian ..... H01R 13/6463
9,287,668 B2 * 3/2016 Chen ..... H01R 13/6658
9,312,644 B2 * 4/2016 Kao ..... H01R 13/6591
9,525,227 B2 * 12/2016 Little ..... H01R 13/6273
2011/0195609 A1 * 8/2011 Su ..... H01R 4/2433 439/660
2011/0281464 A1 * 11/2011 Hou ..... H01R 13/6593 439/607.55
2012/0028495 A1 * 2/2012 Su ..... H01R 9/03 439/449
2015/0024612 A1 * 1/2015 Little ..... H05K 1/117 439/55
2015/0171561 A1 * 6/2015 Little ..... H01R 24/60 439/607.34
2015/0303622 A1 * 10/2015 Tao ..... H01R 13/6581 439/607.55

* cited by examiner

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

151

152

FIG.1C

ELECTRICAL PLUG CONNECTOR

CROSS-REFERENCES TO RELATED APPLICATIONS

This non-provisional application claims priority under 35 U.S.C. §119(a) on Patent Application No. 201410694120.6 filed in China, P.R.C. on 2014 Nov. 27, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

An existing USB electrical plug connector includes an insulated housing, a plurality of terminals, and a rear base. In assembly, firstly the terminals are assembled in the insulated housing, and then the rear base is assembled to the insulated housing, so that the legs of the terminals can be exposed from the rear of the rear base and soldered with a circuit board.

Generally, during the process of forming the plastic shell of an existing USB electrical plug connector, in order to prevent the components on a circuit board in the connector from being deformed or shifted upon impact generated when the plastic material is being filled, a protecting cover layer is preformed on the circuit board to protect the components on the circuit board. However, the protecting cover only covers the peripheral of the circuit board rather than covering both the circuit board and an insulated shell in front of the circuit board. Therefore, the structural strength of the existing USB electrical plug connector cannot be improved.

SUMMARY OF THE INVENTION

Consequently, how to improve the existing electrical plug connector becomes an issue and is diligently developed by the applicant.

In view of this, an exemplary embodiment of the instant disclosure provides an electrical plug connector comprising a metallic shell, an insulated housing, a plurality of upper-row plug terminals, a plurality of lower-row plug terminals, and a rear terminal organizer. The metallic shell defines a receiving cavity therein. The insulated housing is received in the receiving cavity and comprises an upper portion, a lower portion, and a mating room. The upper portion has an upper mating face, the lower portion has a lower mating face, and the upper mating face faces the lower mating face. The mating room is defined at the front of the insulated housing and between the upper portion and the lower portion. The upper-row plug terminals comprise a plurality of upper signal pairs for signal transmission, at least one power terminal, and at least one ground terminal. The upper-row plug terminals are held in the upper portion of the insulated housing and partly exposed upon the upper mating face of the upper portion. The lower-row plug terminals comprise a plurality of lower signal pairs for signal transmission, at least one power terminal, and at least ground terminal. The lower-row plug terminals are held in the lower portion of the insulated housing and partly exposed upon the lower mating face of the lower portion. The rear terminal organizer is assembled to a rear of the insulated housing. The rear terminal organizer comprises a base and defines a gluing passage. The front of the base corresponds to the rear of the insulated housing. The width of the base is greater than the width of the insulated housing. The cross sectional area of the base is greater than the cross sectional area of the insulated housing. The gluing passage is formed at the periphery of the base, and the gluing passage is defined through the base from the front of the base to the rear of the base.

Based on the above, a gluing passage is defined at the base of the rear terminal organizer for allowing the glue passing through and extending to the rear of the metallic shell, so that the glue is fixed to form a covering member to cover the insulated housing, the tail portions of the upper-row plug terminals, and the tail portions of the lower-row plug terminals. Therefore, during the formation of the insulated shell, the wires, the tail portions of the upper-row plug terminals, and the tail portions of the lower-row plug terminals can be prevented from being shifted, tilted, or deformed upon suffering impact. Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 1C illustrates a schematic configuration diagram of plug terminals of the electrical plug connector shown in FIG. 1B;

DETAILED DESCRIPTION

Figure 1:
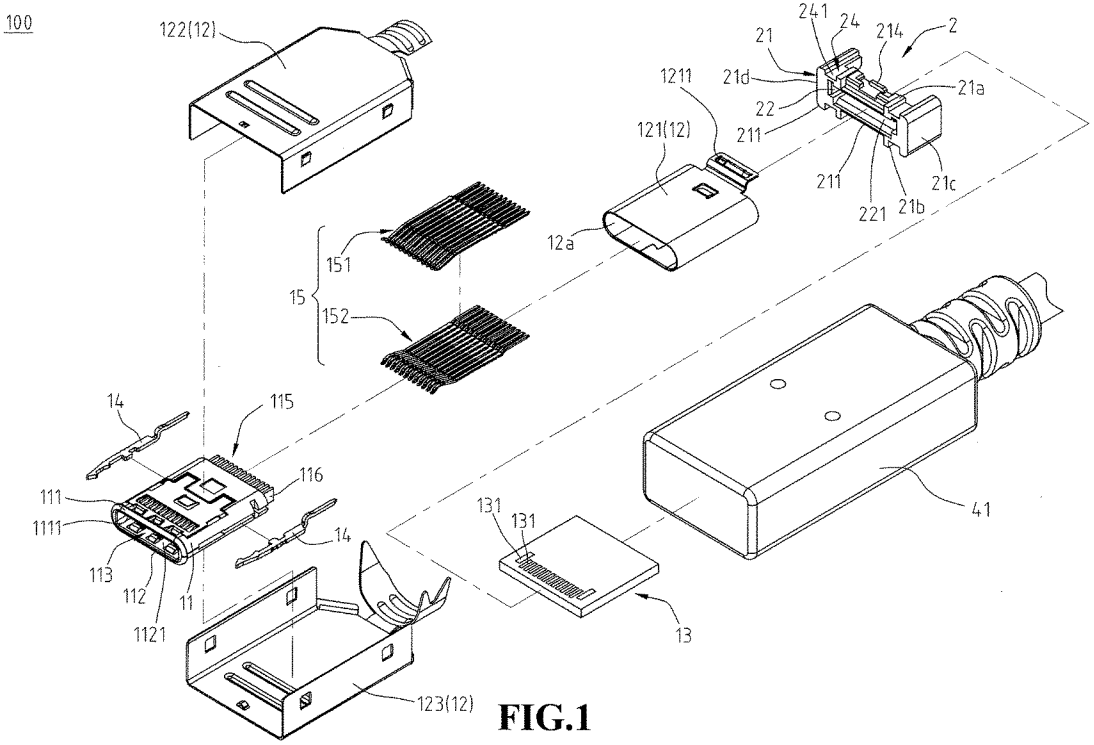
FIG. 1 illustrates an exploded view of an electrical plug connector according to an exemplary embodiment of the instant disclosure.
Figure 2:
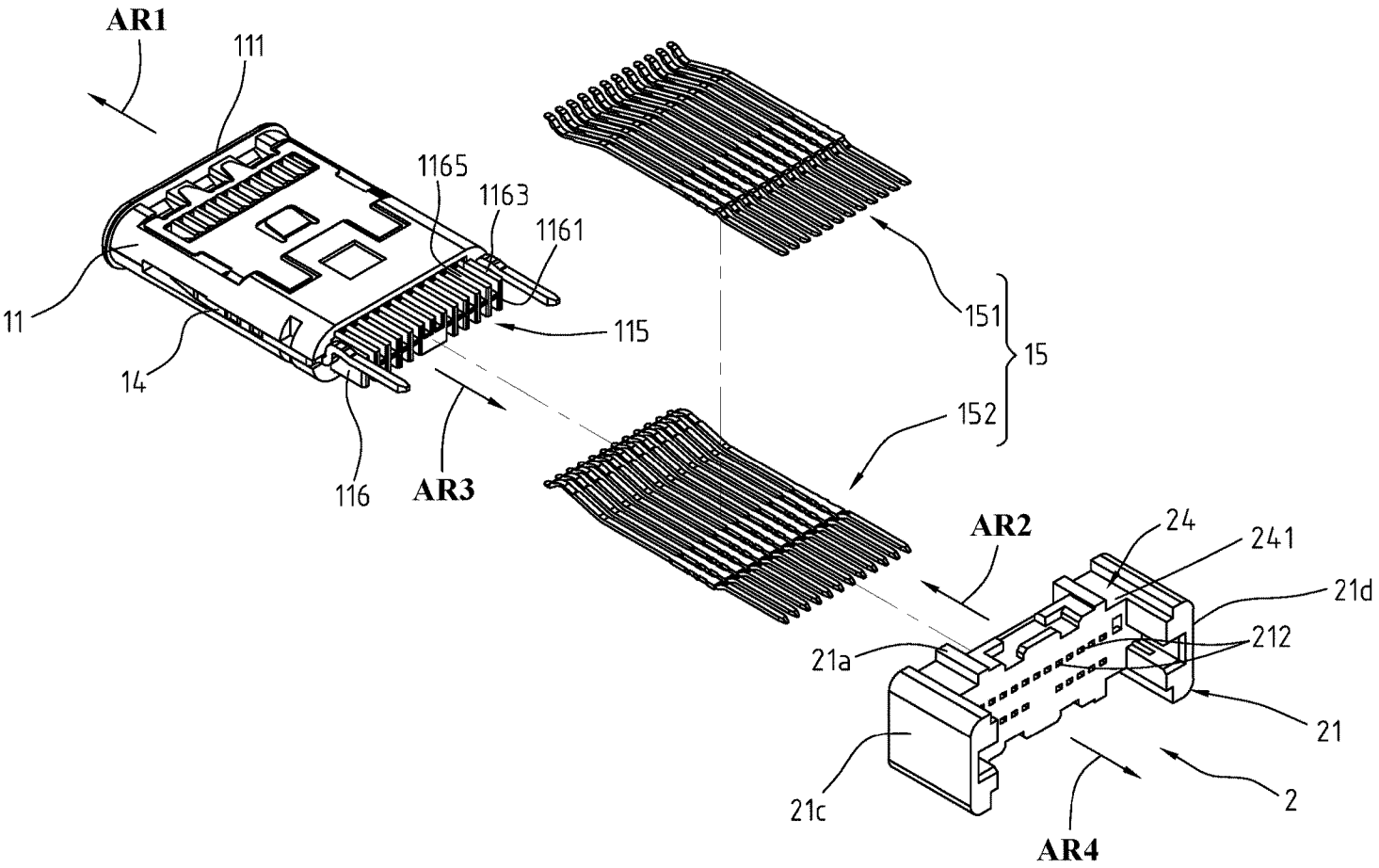
FIG. 2 illustrates an exploded view from the bottom showing a rear terminal organizer is assembled with an assembly of an insulated housing and plug terminals of the electrical plug connector of FIG. 1.
Figure 3A:
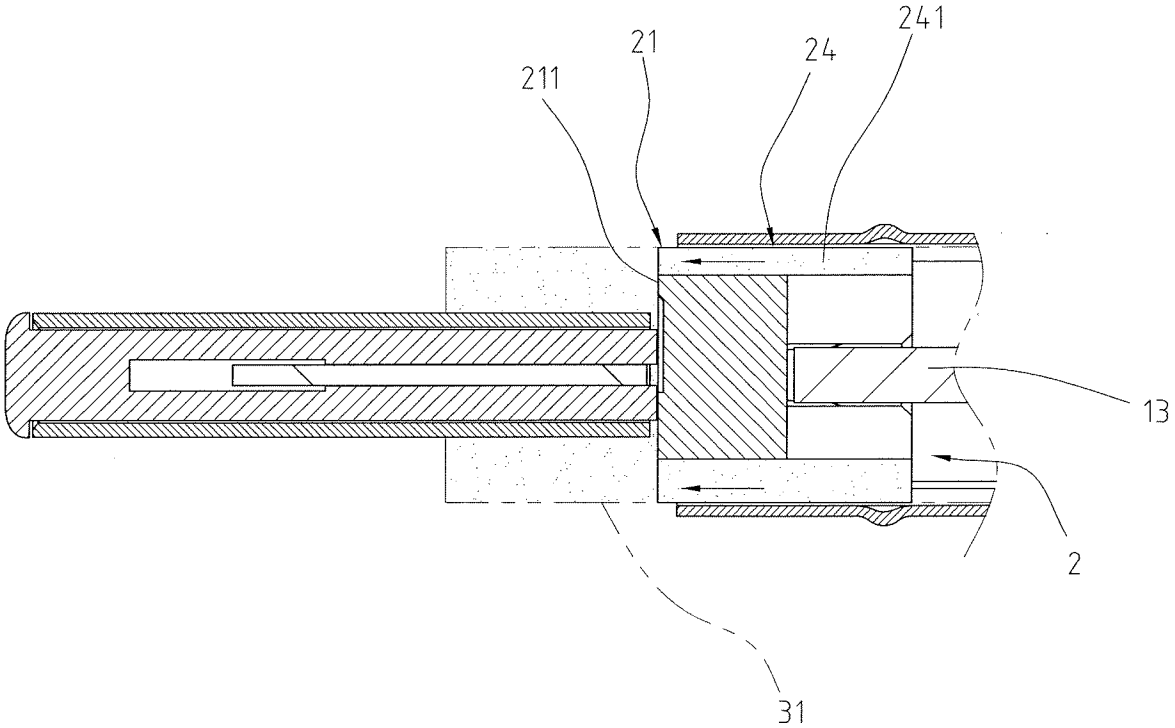
FIG. 3A illustrates a side sectional view of the electrical plug connector according to a first embodiment of the instant disclosure.

Please refer to FIG. 1 to FIG. 3A, which illustrate an electrical plug connector of an exemplary embodiment according to the instant disclosure. FIG. 1 illustrates an exploded view (1) of an electrical plug connector 100 of an exemplary embodiment. FIG. 2 illustrates an exploded view from the bottom showing a rear terminal organizer 2 is assembled with an assembly of an insulated housing 11 and plug terminals 15 of the electrical plug connector 100 of FIG. 1. FIG. 3A illustrates a side sectional view of the electrical plug connector 100 according to a first embodiment of the instant disclosure. In this embodiment, the electrical plug connector 100 can provide a reversible or dual orientation USB Type-C connector interface and pin assignments, i.e., a USB Type-C plug connector. In this embodiment, the electrical plug connector 100 comprises the insulated housing 11, a plurality of plug terminals 15, a metallic shell 12, and the rear terminal organizer 2. Furthermore, the electrical plug connector 100 comprises a circuit board 13, a wire, and an insulated shell 41.

Figure 4:
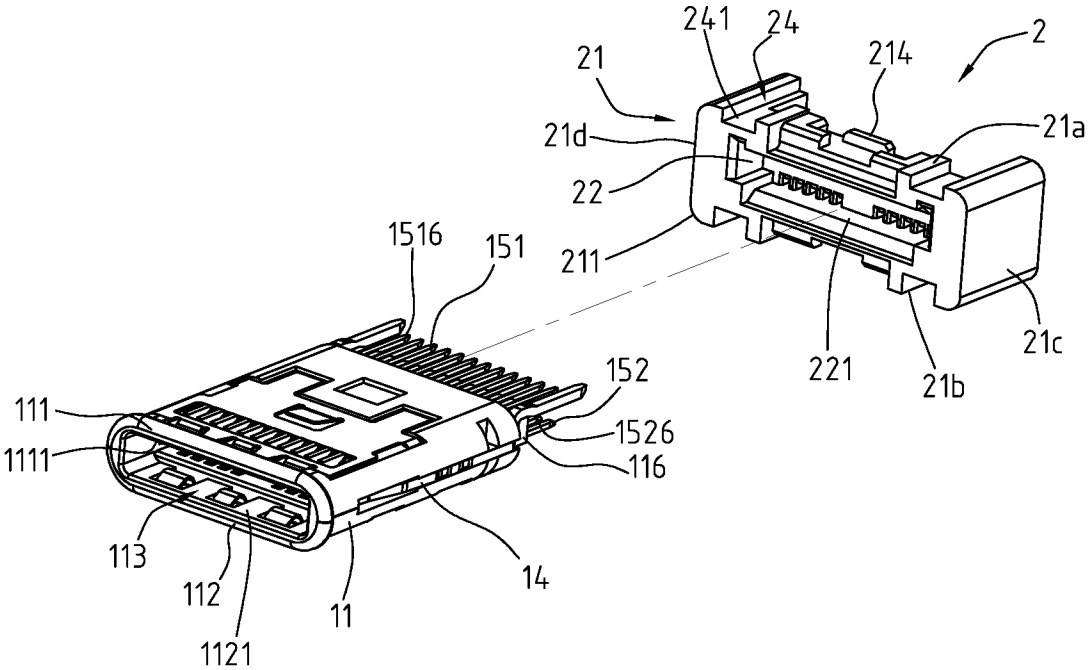
FIG. 4 illustrates an exploded view from the top showing the insulated housing is assembled with the rear terminal organizer of the electrical plug connector of FIG. 1.
Figure 5:
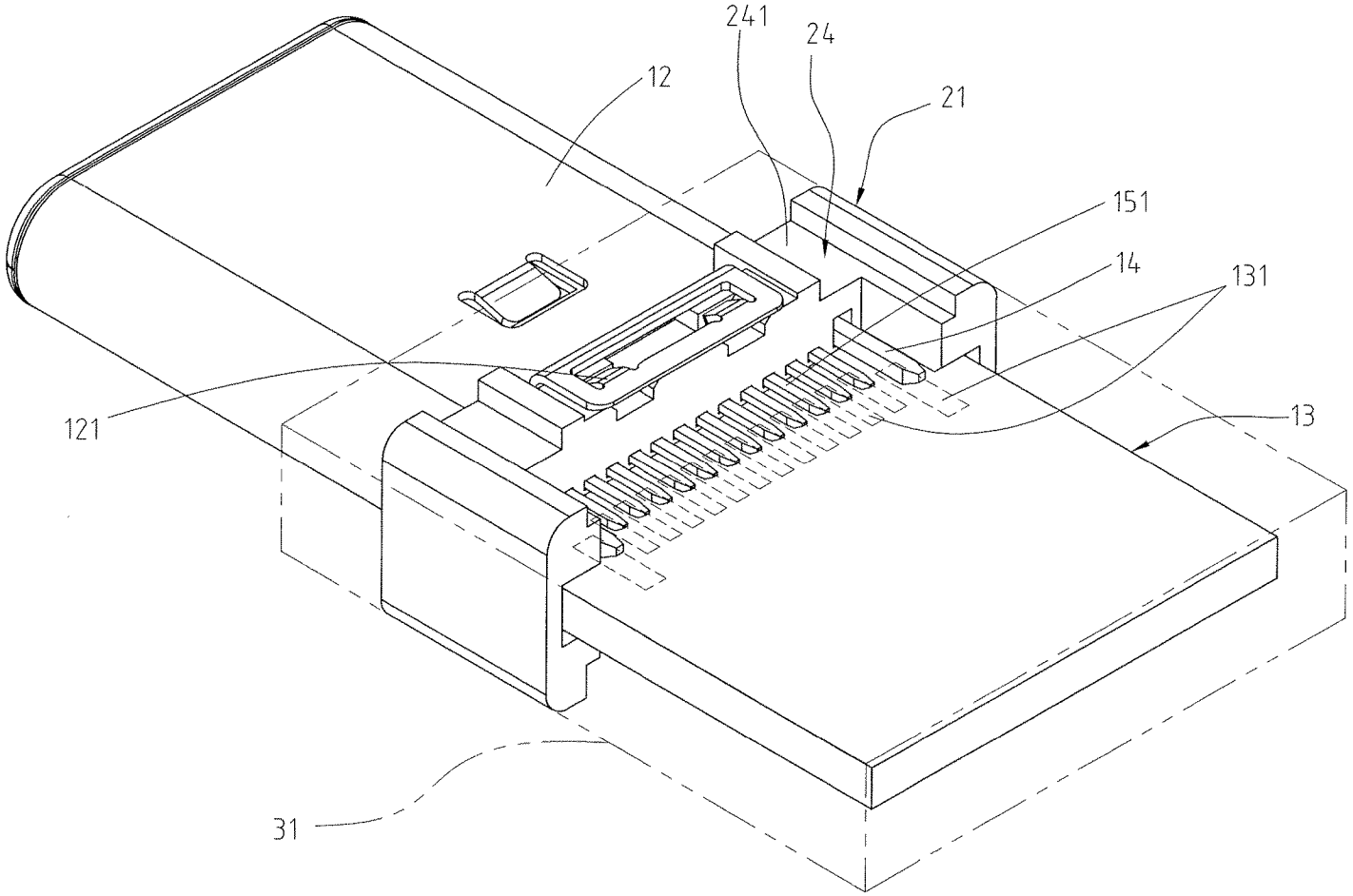
FIG. 5 illustrates a schematic perspective view of the electrical plug connector assembled with a circuit board.

Please refer to FIG. 4 and FIG. 5. The insulated housing 11 is an elongate plate and comprises an upper portion 111, a lower portion 112, a mating room 113, and a rear assembling portion 115. Here, the upper portion 111 and the lower portion 112 of the insulated housing 11 are respectively injection molded or the like. The mating room 113 is defined at the front of the insulated housing 11. The front of the insulated housing 11 defines as an inserting part for being inserted into an electrical receptacle connector, while the rear of the insulated housing 11 defines a positioning part and opposite to the inserting part. The facing direction AR2 of the front of the rear terminal organizer 2 is the same as the facing direction AR1 of the front of the insulated housing 11, and the facing direction AR4 of the rear of the rear terminal organizer 2 is the same as the facing direction AR3 of the rear of the insulated housing 11, as shown in FIG. 2. In addition, the mating room 113 is defined between the upper portion 111 and the lower portion 112. In this embodiment, the rear assembling portion 115 is formed at the rear of the insulated housing 11. The rear assembling portion 115 may be, but not limited to, a protruded block 116 extended outward from the rear of the insulated housing 11. The protruded block 116 includes a first partitioning plate 1161 and a plurality of second partitioning plates 1163, wherein the second partitioning plates 1163 are substantially perpendicular to the first partitioning plate 1161 to form a plurality of positioning grooves 1165 between two adjacent second partitioning plates 1163. In addition, the positioning grooves 1165 are arranged in two rows. Moreover, the upper portion 111 has an upper mating face 1111, the lower portion 112 has a lower mating face 1121, and the upper mating face 1111 is faced toward the lower mating face 1121.

Please refer to FIG. 1A, FIG. 1B, FIG. 4, and FIG. 5. The plug terminals 15 are configured in the upper portion 111 and the lower portion 112. The plug terminals 15 comprise a plurality of upper-row plug terminals 151 and a plurality of lower-row plug terminals 152.

Figure 1A:
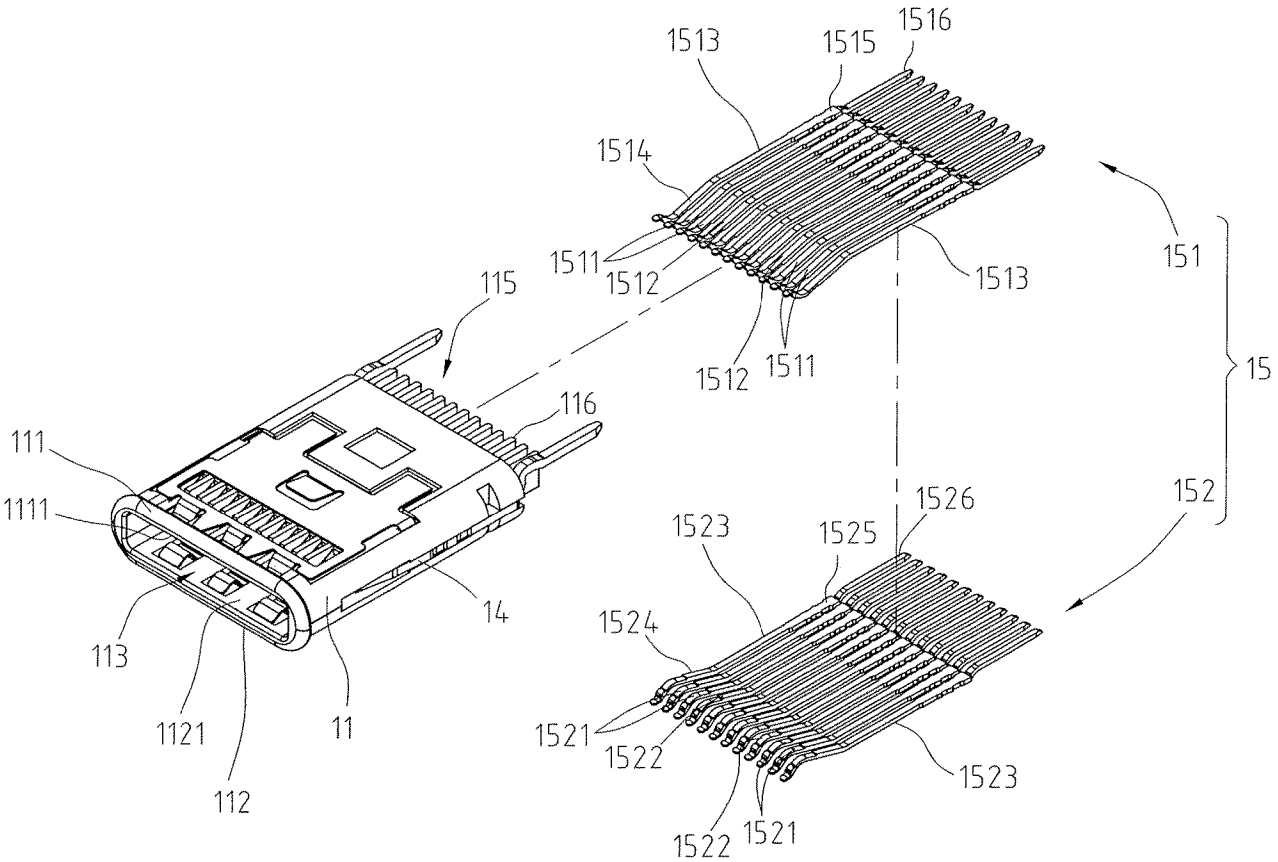
FIG. 1A illustrates a partial exploded view of the electrical plug connector of FIG. 1.
Figure 1B:
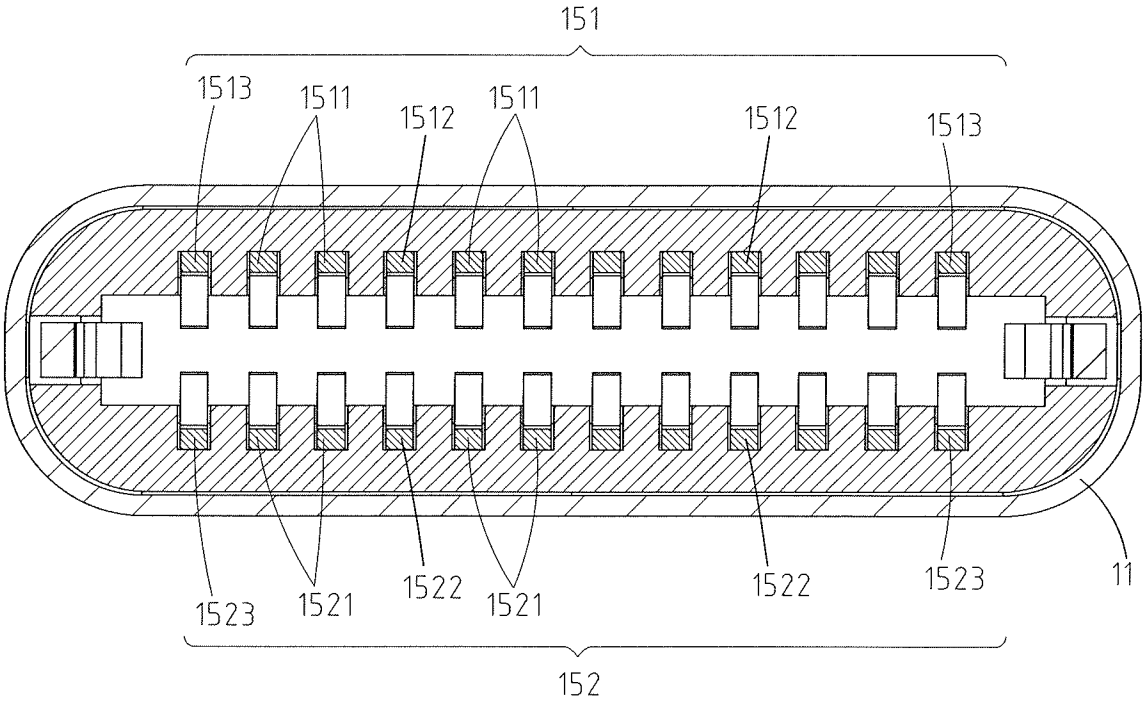
FIG. 1B illustrates a front sectional view of the electrical plug connector of the exemplary embodiment.

Please refer to FIG. 1A, FIG. 1B, and FIG. 1C. The upper-row plug terminals 151 are held in the upper portion 111 of the insulated housing 11 and partly exposed upon the upper mating face 1111 of the upper portion 111. Here, the upper-row plug terminals 151 comprise a plurality of upper signal pairs 1511 for signal transmission, at least one power terminal 1512, and at least one ground terminal 1513. Specifically, as depicted in FIG. 1C, the upper-row plug terminals 151 comprise, from right to left, a ground terminal 1513 (Gnd), a first upper signal pair (TX1+−) 1511, a second upper signal pair (D+−) 1511, a third upper signal pair (RX2+−) 1511, two power terminals 1512 (Power/VBUS) between the three pairs of upper signal pairs 1511, a retain terminal (RFU), (the retain terminal and a configuration channel 1 (CC1) are respectively arranged between the power terminals 1512 and the second upper signal pair (D+−) 1511), and a ground terminal 1513 (Gnd) at the leftmost.

Please refer to FIG. 1A, FIG. 1B, and FIG. 1C. Each of the upper-row plug terminals 151 comprises a flexible contact portion 1514, a body portion 1515, and a tail portion 1516. For each of the upper-row plug terminals 151, the body portion 1515 is held in the upper portion 111, the flexible contact portion 1514 is extended forward from the body portion 1515 in the rear-to-front direction and partly exposed upon the upper mating face 1111 of the upper portion 111, and the tail portion 1516 is extended backward from the body portion 1515 in the front-to-rear direction and protruded from the insulated housing 11. The upper signal pairs 1511 partly project into the mating room 113 and are provided for transmitting first signals (i.e., USB 3.0 signals.). The tail portions 1516 of the upper-row plug terminals 151 are extended from the rear of the insulated housing 11 and aligned horizontally to form flat legs, named SMT legs which can be soldered or mounted on the surface of a circuit board using surface mount technology, as shown in FIG. 1A.

Please refer to FIG. 1A, FIG. 1B, and FIG. 1C. The lower-row plug terminals 152 are held in the lower portion 112 of the insulated housing 11 and partly exposed upon the lower mating face 1121 of the lower portion 112. Here, the lower-row plug terminals 152 comprise a plurality of lower signal pairs 1521 for signal transmission, at least one power terminal 1522, and at least one ground terminal 1523. Specifically, as shown in FIG. 1C, the lower-row plug terminals 152 comprise, from left to right, a ground terminal 1523 (Gnd), a first lower signal pair (TX2+−) 1521, a second lower signal pair (D+−) 1521, a third lower signal pair (RX1+−) 1521, two power terminals 1522 (Power/VBUS) between the three pairs of lower signal pairs 1521, a retain terminal (RFU), (the retain terminal and a configuration channel 2 (CC2) are respectively arranged between the power terminals 1522 and the second lower signal pair (D+−) 1521), and a ground terminal 1523 (Gnd) at the rightmost.

Please refer to FIG. 1A, FIG. 1B, and FIG. 1C. Each of the lower-row plug terminals 152 comprises a flexible contact portion 1524, a body portion 1525, and a tail portion 1526. For each of the lower-row plug terminals 152, the body portion 1525 is held in the lower portion 112, the flexible contact portion 1524 is extended forward from the body portion 1525 in the rear-to-front direction and partly exposed upon the lower mating face 1121 of the lower portion 112, and the tail portion 1526 is extended backward from the body portion 1525 in the front-to-rear direction and protruded from the insulated housing 11. The lower signal pairs 1521 partly project into the mating room 113 and are provided for transmitting second signals (i.e., USB 3.0 signals). The tail portions 1526 of the lower-row plug terminals 152 are extended from the rear of the insulated housing 11 and aligned horizontally to form flat legs, named SMT legs which can be soldered or mounted on the surface of a circuit board using surface mount technology, as shown in FIG. 1A. Moreover, as shown in FIGS. 2 and 4, the tail portions 1516 of the upper-row plug terminals 151 and the tail portions 1526 of the lower-row plug terminals 152 are respectively positioned in the positioning grooves 1165. In detail, the tail portions 1516 of the upper-row plug terminals 151 are positioned in the upper row of the positioning grooves 1165 and the tail portions 1526 of the lower-row plug terminals 152 are positioned in the lower row of the positioning grooves 1165.

Please refer to FIG. 1A, FIG. 1B, and FIG. 1C. It is understood that, in this embodiment, the upper-row plug terminals 151 and the lower-row plug terminals 152 are respectively at the upper mating face 1111 of the upper portion 111 and the lower mating face 1121 of the lower portion 112. Additionally, pin-assignments of the upper-row plug terminals 151 and the lower-row plug terminals 152 are point-symmetrical with a central point of a receiving cavity 12*a* of the metallic shell 12 as the symmetrical center. Here, point-symmetry means that after the upper-row plug terminals 151 (or the lower-row plug terminals 152), are rotated by 180 degrees with the symmetrical center as the rotating center, the upper-row plug terminals 151 and the lower-row plug terminals 152 are overlapped. That is, the rotated upper-row plug terminals 151 are arranged at the position of the original lower-row plug terminals 152, and the rotated lower-row plug terminals 152 are arranged at the position of the original upper-row plug terminals 151. Accordingly, the electrical plug connector 100 can have a 180 degree symmetrical, dual or double orientation design and pin assignments which enables the electrical plug connector 100 to be inserted into a corresponding receptacle connector in either of two intuitive orientations, i.e. in either upside-up or upside-down directions. In other words, the upper-row plug terminals 151 and the lower-row plug terminals 152 are arranged upside down, and the pin assignment of the upper-row plug terminals 151 is left-right reversal with respect to that of the lower-row plug terminals 152. Accordingly, the electrical plug connector 100 is inserted into an electrical receptacle connector with a first orientation where the lower mating face 1121 of the lower portion 112 is facing up, for transmitting first signals. Conversely, the electrical plug connector 100 is inserted into the electrical receptacle connector with a second orientation where the lower mating face 1121 of the lower portion 112 is facing down, for transmitting second signals. Furthermore, the specification for transmitting the first signals is conformed to the specification for transmitting the second signals. Note that, the inserting orientation of the electrical plug connector 100 is not limited by the instant disclosure.

Please refer to FIG. 1A, FIG. 1B, and FIG. 1C. The position of the upper-row plug terminals 151 correspond to the position of the lower-row plug terminals 152.

Please refer to FIG. 1, FIG. 1B, and FIG. 3A. The metallic shell 12 is hollowed and defines a receiving cavity 12*a* therein. The receiving cavity 12*a* is adapted to receive and enclose the insulated housing 11. In this embodiment, the metallic shell 12 is a multi-piece member, but embodiments are not limited thereto. Alternatively, in some embodiments, the metallic shell 12 may be formed by bending a unitary member. The metallic shell 12 can be combined by three pieces, such as inner metal shell 121, upper outer metal shell 122, and lower outer metal shell 123.

Please refer to FIG. 1, FIG. 2, FIG. 3A, FIG. 4, and FIG. 5. In this embodiment, the rear terminal organizer 2 is assembled to the rear of the insulated housing 11. The rear terminal organizer 2 comprises a base 21, at least one gluing passage 24, a plurality of buckling blocks 214, a plurality of through holes 212, and a buckling portion 22.

The front of the base 21 corresponds to the rear of the insulated housing 11. The width of the base 21 is greater than the width of the insulated housing 11. The periphery of the base 21 is protruded from the periphery of the insulated housing 11. In other words, the cross sectional area of the base 21 is greater than the cross sectional area of the insulated housing 11, i.e., the distance between the top and the bottom of the base 21 is greater than the distance between the top and the bottom of the metallic shell 12, and the distance between the left side and the right side of the base 21 is greater than the distance between the left side and the right side of the metallic shell 12.

Figure 3B:
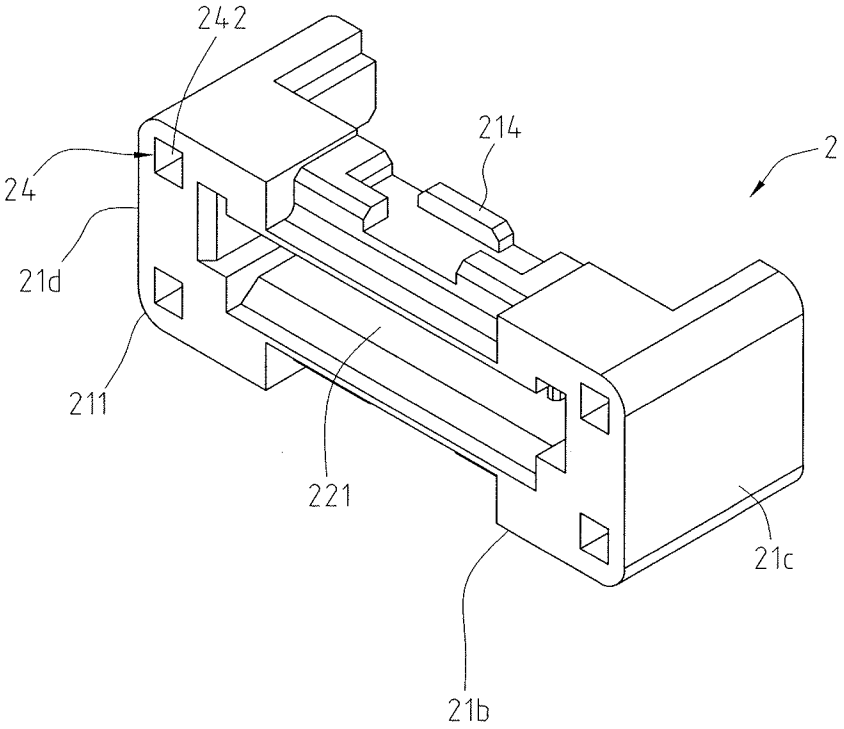
FIG. 3B illustrates a perspective view of a second embodiment of a rear terminal organizer of the electrical plug connector according to the instant disclosure.
Figure 3C:
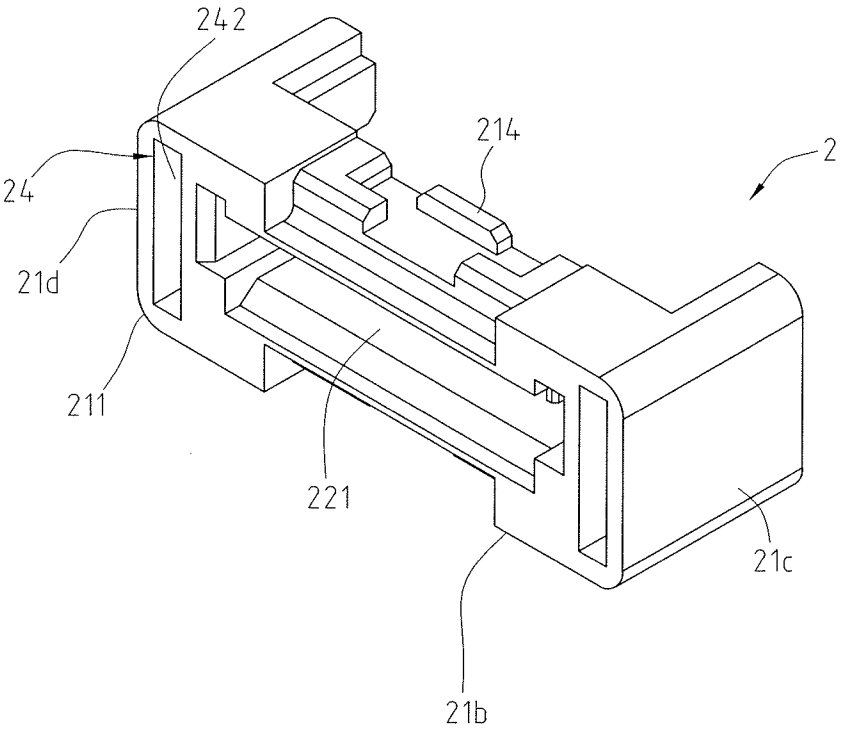
FIG. 3C illustrates a perspective view of a third embodiment of a rear terminal organizer of the electrical plug connector according to the instant disclosure.
Figure 3D:
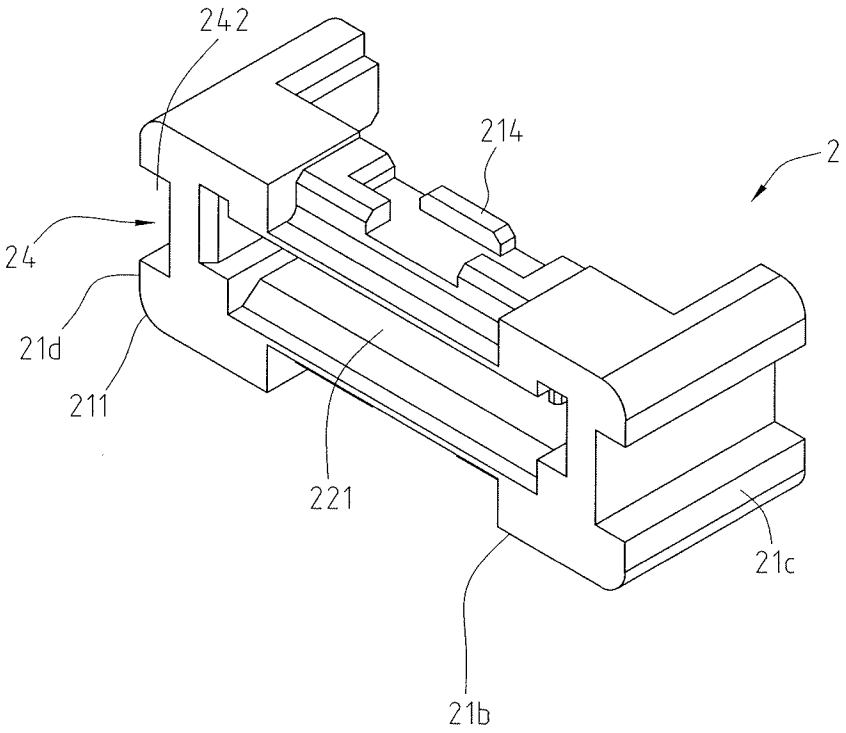
FIG. 3D illustrates a perspective view of a fourth embodiment of a rear terminal organizer of the electrical plug connector according to the instant disclosure.

The gluing passage 24 is formed at a peripheral area 211 of the base 21, and the gluing passage 24 is defined through the base 21 from the front to the rear. In this embodiment, the rear terminal organizer 2 defines a plurality of gluing passages 24, and the gluing passages 24 are formed at two sidewalls of the base 21. In addition, the gluing passages 24 respectively define groove structures 241, and the groove structures 241 are located at two sides of the top surface 21*a* of the base 21 and two sides of the bottom surface 21*b* of the base 21. In other words, the two sides of the top surface 21*a* of the base 21 and the two sides of the bottom surface 21*b* of the base 21 are recessed to form the groove structures 241, but embodiments are not limited thereto. In some embodiments, the gluing passages 24 may be formed at a right sidewall and a left sidewall of the base 21 (as shown in FIG. 3D). In addition, the gluing passage 24 may be formed as one or more through-hole structure 242 and defined through the base 21 (as shown in FIG. 3B and FIG. 3C). That is, the groove structures 241 may be replaced by the through-hole structures 242 for filling plastic material therethrough.

The buckling blocks 214 are respectively formed at the center of the top of the base 21 and the center of the bottom of the base 21. The buckling blocks 214 are protruded structures. The metallic shell 12 further comprises a plurality of buckling rings 1211. Each of the buckling rings 1211 is buckled with the corresponding buckling block 214, so that the metallic shell 12 is securely positioned with the base 21.

The through holes 212 are defined through the base 21, from the front to the rear. The rear of the upper-row plug terminals 151 and the rear of the lower-row plug terminals 152 are exposed from the rear of the insulated housing 11. Moreover, when the base 21 is assembled to the rear of the insulated housing 11, the rear of the upper-row plug terminals 151 and the rear of the lower-row plug terminals 152 pass through the through holes 212, respectively.

The buckling portion 22 is formed at the front of the base 21. The buckling portion 22 is mated with the rear assembling portion 115 and adapted to be engaged with the rear assembling portion 115. In this embodiment, the buckling portion 22 is a recessed groove 221, but embodiments are not limited thereto. In addition, as mentioned the rear assembling portion 115 may be a protruded block 116, and the protruded block 116 is to be engaged in the recessed groove 221. In this embodiment, the buckling portion 22 comprises a plurality of guiding inclined surfaces defined around the periphery thereof. The guiding inclined surfaces are provided for guiding the assembling between the insulated housing 11 and the rear terminal organizer 2. In other words, when the buckling portion 22 is to be assembled with the rear assembling portion 115, the guiding inclined surfaces guide the protruded block 116 to be assembled in the recessed groove 221 conveniently. Additionally, in some embodiments, the rear assembling portion 115 may be formed as an engaging groove, and the buckling portion 22 may be an engaging block. The size of the engaging groove mates with the size of the engaging block, such that the engaging block can be engaged in the engaging groove. In other words, the buckling portion 22 and the rear assembling portion 115 may have correspondingly mating structures like protrusions and corresponding recesses, so that the mating structures can be mated with each other. Moreover, the width of the rear assembling portion 115 is substantially equal to the width of the buckling portion 22. As a result, when the buckling portion 22 is assembled with the rear assembling portion 115, the buckling portion 22 is securely positioned with the rear assembling portion 115.

Please refer to FIG. 1 and FIG. 5. The circuit board 13 is located at the rear of the base 21 and has a plurality of contact pads 131. The contact pads 131 comprise a plurality of ground contact pads and a plurality of terminal contact pads. The ground contact pads and the terminal contact pads are configured at one side of the circuit board 13. The terminal contact pads are located between the ground contact pads. The tail portions 1516 of the upper-row plug terminals 151 and the tail portions 1526 of the lower-row plug terminals 152 are respectively soldered with the terminal contact pads.

Please refer to FIG. 1, FIG. 1B, and FIG. 5. The electrical plug connector 100 further comprises a plurality of latches 14 configured at two sides of the insulated housing 11. The latches 14 may be, but not limited to, formed by blanking technique. In some embodiments, the latches 14 may be formed by stamping technique. It is understood that the structural strength of the latches 14 formed by blanking technique is greater than that of the latches 14 formed by stamping technique. The latches 14 are configured at the insulated housing 11 and in contact with the metallic shell 12. Each of the latches 14 comprises a side arm, a hook portion, and a leg portion. The side arm is an elongated shape, and the side arm is adapted to be received in one of grooves at the sidewalls of the insulated housing 11. The hook portion is extended from the front of the side arm toward the mating room 113, and the hook portion is partly projected into the mating room 113. The leg portion is extended from the rear of the side arm. The leg portion is protruded from the rear of the groove and exposed out of the insulated housing 11, and the leg portion is further extended to the circuit board 13 to be soldered with one of the ground contact pads 131. The leg portion is substantially parallel to the tail portions 1516 of the upper-row plug terminals 151 and the tail portions 1526 of the lower-row plug terminals 152.

When the electrical plug connector 100 is mated with an electrical receptacle connector, the hook portions of the latches 14 are engaged with engaging portions of the electrical receptacle connector, so that the hook portions would not wear against two sides of a tongue portion of the electrical receptacle connector to damage the tongue portion. Additionally, the latches 14 of the electrical plug connector 100 are partly exposed and in contact with the metallic shell 12, so that the latches 14 of the electrical plug connector 100 are provided for noise conduction and grounding of the electrical plug connector 100.

Please refer to FIG. 3A and FIG. 5. The electrical plug connector 100 further comprises a covering member 31. The covering member 31 is extended from the rear of the base 21, through the gluing passage 24, and extended toward the rear of the metallic shell 12. The covering member 31 covers the wire, the tail portions 1516 of the upper-row plug terminals 151, and the tail portions 1526 of the lower-row plug terminals 152. In this embodiment, after the wires are soldered with the circuit board 13, the circuit board 13 may be assembled with the covering member 31 by means of glue dispensing, over molding, or the like. The covering member 31 is formed by filling plastic materials (glues) into the electrical plug connector 100 from the rear of the base 21 (i.e., from the rear of the circuit board 13), and the glue is Polyethylene (PE). After the gluing process, the glue flows to the rear of the metallic shell 12 through the gluing passage 24. The size and the position of the glue structure (i.e., the crude product of the covering member 31) can be confined by a fixture, so that the glue structure is formed (fixed) around the circuit board 13 and extended through the gluing passage 24 to the rear of the metallic shell 12. Therefore, the fixed glue structure (i.e., the covering member 31) can protect the wires, the tail portions 1516 of the upper-row plug terminals 151, and the tail portions 1526 of the lower-row plug terminals 152 soldered on the circuit board 13. Furthermore, refer to FIG. 1 again, the insulated shell 41 is further formed out of the covering member 31 by means of over molding, and the insulated shell 41 is made of polyvinylchloride (PVC). Accordingly, by covering the covering member 31 with the insulated shell 41, an electrical plug connector 100 having transmission wires can be provided. When a covering member 31 is further applied to the electrical plug connector 100, the covering member 31 covers the wires or covers the tail portions 1516 of the upper-row plug terminals 151 and the tail portions 1526 of the lower-row plug terminals 152. Therefore, during the formation of the insulated shell 41, the wires and the tail portions 1516, 1526 can be prevented from being shifted, tilted, or deformed upon suffering impact.

Based on the above, a gluing passage is defined at the base of the rear terminal organizer for allowing the glue passing through and extending to the rear of the metallic shell, so that the glue is fixed to form a covering member to cover the insulated housing, the tail portions of the upper-row plug terminals, and the tail portions of the lower-row plug terminals. Therefore, during the formation of the insulated shell, the wires, the tail portions of the upper-row plug terminals, and the tail portions of the lower-row plug terminals can be prevented from being shifted, tilted, or deformed upon suffering impact.

Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell, defining a receiving cavity therein;

an insulated housing received in the receiving cavity, the insulated housing comprising an upper portion, a lower portion, a mating room, a rear assembling portion, wherein the mating room is defined at the front of the insulated housing and between the upper portion and the lower portion, the upper portion has an upper mating face, the lower portion has a lower mating face, the upper mating face is faced toward the lower mating face, the rear assembling portion is a protruded block extended outward from the rear of the insulated housing;

a plurality of upper-row plug terminals held in the insulated housing and located upon the upper mating face of the upper portion;

a plurality of lower-row plug terminals held in the insulated housing and located upon the lower mating face of the lower portion;

two latches respectively configured at two sides of the insulated housing, wherein each of the two latches comprises a side arm and a hook portion, the side arm is an elongated shape and adapted to be received in a groove at one of the sidewalls of the insulated housing, the hook portion is extended from the front of the side arm toward the mating room, and the hook portion is partly projected into the mating room;

a rear terminal organizer, assembled to a rear of the insulated housing, the rear terminal organizer comprising:

a base, wherein the front of the base corresponds to the rear of the insulated housing, the width of the base is greater than the width of the insulated housing, and the cross sectional area of the base is greater than the cross sectional area of the insulated housing;

a gluing passage formed at a sidewall of the base, wherein the gluing passage is defined through the base from the front of the base to the rear of the base; and a buckling portion formed at the front of the base, and mated with the rear assembling portion, wherein the buckling portion is a recessed groove and the rear assembling portion is engaged in the recessed groove; and a covering member extended from the rear of base, through the gluing passage, and toward the rear of the metallic shell.

2. The electrical plug connector according to claim 1, wherein the gluing passage defines a groove structure located at a side of the top surface of the base or a side of the bottom surface of the base.

3. The electrical plug connector according to claim 1, wherein the gluing passage is formed at a right sidewall or a left sidewall of the base.

4. The electrical plug connector according to claim 1 wherein the gluing passage defines a through-hole structure and the through-hole structure is defined through the base.

5. The electrical plug connector according to claim 1, wherein the rear terminal organizer further comprises a plurality of buckling blocks respectively formed at the top and the bottom of the base, and wherein the metallic shell further comprises a plurality of buckling rings, each of the buckling rings is buckled with the corresponding buckling block.

6. The electrical plug connector according to claim 1, further comprising a circuit board assembled to the rear of the rear terminal organizer, wherein the circuit board comprises a plurality of terminal contact pads connected to rear of the upper-row plug terminals and rear of the lower-row plug terminals, wherein the covering member is fixed around the circuit board and extended through the gluing passage to the rear of the metallic shell.

7. The electrical plug connector according to claim 1, wherein each of the upper-row plug terminals comprises a flexible contact portion, a body portion, and a tail portion, wherein the body portion is held in the upper portion, the flexible contact portion is extended forward from the body portion in the rear-to-front direction and partly exposed upon the upper mating face of the upper portion, and the tail portion is extended backward from the body portion in the front-to-rear direction and protruded from the insulated housing, wherein the covering member covers the tail portions of the upper-row plug terminals.

8. The electrical plug connector according to claim 1, wherein each of the lower-row plug terminals comprises a flexible contact portion, a body portion, and a tail portion, wherein the body portion is held in the lower portion, the flexible contact portion is extended forward from the body portion in the rear-to-front direction and partly exposed upon the lower mating face of the lower portion, and the tail portion is extended backward from the body portion in the front-to-rear direction and protruded from the insulated housing, wherein the covering member covers the tail portions of the lower-row plug terminals.

9. The electrical plug connector according to claim 1, wherein the upper-row plug terminals and the lower-row plug terminals have 180 degree symmetrical design with respect to a central point of the receiving cavity as the symmetrical center.

10. The electrical plug connector according to claim 9, wherein the position of the upper-row plug terminals correspond to the position of the lower-row plug terminals.

11. The electrical plug connector according to claim 1, wherein each latch further comprises a leg portion, the leg portion is extended from the rear of the side arm, the leg portion is protruded from the rear of the groove and exposed out of the insulated housing, and the leg portion is further extended to the circuit board to be soldered with the ground contact pad, and wherein the leg portion is substantially parallel to tail portions of the upper-row plug terminals and tail portions of the lower-row plug terminals.

12. The electrical plug connector according to claim 1, wherein the latch is in contact with the metallic shell.

13. The electrical plug connector according to claim 1, wherein the buckling portion comprises a plurality of guiding inclined surfaces defined around the periphery thereof.

14. The electrical plug connector according to claim 1, wherein the upper-row plug terminals comprise a plurality of pairs of upper signal pairs for signal transmission, at least one power terminal, and at least one ground terminal.

15. The electrical plug connector according to claim 1, wherein the lower-row plug terminals comprise a plurality of pairs of lower signal pairs for signal transmission, at least one power terminal, and at least one ground terminal.

16. The electrical plug connector according to claim 1, wherein the protruded block comprises a first partitioning plate and a plurality of second partitioning plates, the second partitioning plates are substantially perpendicular to the first partitioning plate to form a plurality of positioning grooves between two adjacent second partitioning plates, and the positioning grooves are arranged in two rows.

17. The electrical plug connector according to claim 16, wherein the tail portions of the lower-row terminals are respectively positioned in the positioning grooves, and the tail portions of the upper-row terminals are respectively positioned in the positioning grooves.

18. The electrical plug connector according to claim 1, wherein the cover member is formed by filling glue into the electrical plug connector from the rear of the base such that the glue flows to the rear of the metallic shell through the gluing passage, so that the cover member is fixed around the circuit board and extended through the gluing passage to the rear of the metallic shell.

* * * * *